United States Patent [19]

Ashley

[11] Patent Number: 4,603,615

[45] Date of Patent: Aug. 5, 1986

[54] LIQUID PROPELLANT WEAPON SYSTEM

[75] Inventor: Eugene Ashley, Burlington, Vt.

[73] Assignee: General Electric Company, Burlington, Vt.

[21] Appl. No.: 2,038

[22] Filed: Jan. 8, 1979

[51] Int. Cl.[4] ..... F41F 15/00; F16K 15/14

[52] U.S. Cl. ..... 89/7; 137/512.1

[58] Field of Search ..... 137/512.1, 512.2; 89/1.704, 7

[56] References Cited

U.S. PATENT DOCUMENTS

| | | | |
|---|---|---|---|
| 3,134,399 | 5/1964 | Deminger et al. | 137/512.1 |
| 3,378,029 | 4/1968 | Lee | 137/512.2 X |
| 3,536,094 | 10/1970 | Manley | 137/512.1 |
| 3,763,739 | 10/1973 | Tassie | 89/7 |
| 3,898,999 | 8/1975 | Haller | 137/512.1 |
| 3,999,898 | 12/1976 | Chomczyk et al. | 137/512.1 X |
| 4,043,248 | 8/1977 | Bulman et al. | 89/7 X |
| 4,069,739 | 1/1978 | Ashley | 89/7 X |
| 4,184,508 | 1/1980 | Mayer et al. | 137/512.1 |

FOREIGN PATENT DOCUMENTS

| | | | |
|---|---|---|---|
| 640351 | 12/1936 | Fed. Rep. of Germany | 137/512.1 |
| 564481 | 7/1977 | U.S.S.R. | 137/512.1 |

*Primary Examiner*—David H. Brown

*Attorney, Agent, or Firm*—Bailin L. Kuch

[57] ABSTRACT

This invention has the provision of a liquid propellant gun having an annular piston whose head is formed of nested rings to provide a relatively high rate of flow from the aft face of the head to the forward face of the head.

10 Claims, 15 Drawing Figures

16
20
10
18
24
8
12
22
14

62
28
64
26
41
38
30
40
34
42
36
PROPELLANT FLOW
44
50
32
46
48
58
60
52
56
54

28
26
41
40
42
46
52
58
54
62
64
38
30
34
50
44
32
56

12
16
20
18
24
22
8
14

LIQUID PROPELLANT WEAPON SYSTEM

BACKGROUND OF THE INVENTION

1. Field of the Invention

This invention relates to weapon systems employing a liquid propellant, and particularly to such systems wherein the propellant is continuously pumped into the combustion chamber as the projectile advances along the firing bore.

2. Prior Art

Weapon systems providing traveling charge effects on projectiles, or rockets, or other systems are listed in my earlier patent U.S. Pat. No. 4,069,739 issued on Jan. 24, 1978. In that patent I disclose a recoilless gun having a cased, preloaded cartridge. The cartridge has a burstable diaphragm and an annular piston for continuously pumping liquid into the combustion chamber as the projectile advances along the firing bore. Such weapon systems are also listed in U.S. Pat. No. 4,043,248, issued to M. J. Bulman et al on Aug. 23, 1977. In that patent Bulman et al disclose an annular piston for continuously pumping liquid into a forward combustion chamber and into an aft combustion chamber as the projectile advances along the firing bore.

In most of the prior art liquid propellant guns, a relief valve is required to prevent the flow of liquid propellant through the injection orifices during the filling operation. Conventional spring loaded poppets can be utilized, but achieving a large liquid flow area requires a large number of poppets. Design complexities arise and structural integrity is difficult to maintain.

The use of nested rings in heart valves or compressor valves is shown in U.S. Pat. Nos. 3,134,399, issued to A. Deminger et al on May 26, 1964; 3,378,029, issued to D. E. Lee on Apr. 16, 1968; 3,536,094, issued to F. E. Manley, Jr. on Oct. 27, 1970; 3,898,999, issued to J. D. Haller on Aug. 12, 1975; and 3,999,898, issued to W. Chomczyk et al on Dec. 28, 1976.

An object of this invention is to provide an improved liquid propellant gun having an annular piston whose head is also a massive relief valve for providing a relatively high rate of flow therethrough.

A feature of this invention is the provision of a liquid propellant gun having an annular piston whose head is formed of nested rings to provide a relatively high rate of flow from the aft face of the head to the forward face of the head.

BRIEF DESCRIPTION OF THE DRAWING

These and other objects, advantages and features of the invention will be apparent from the following specification thereof taken in conjunction with the accompanying drawing in which.

DESCRIPTION OF THE INVENTION

Figure 1:
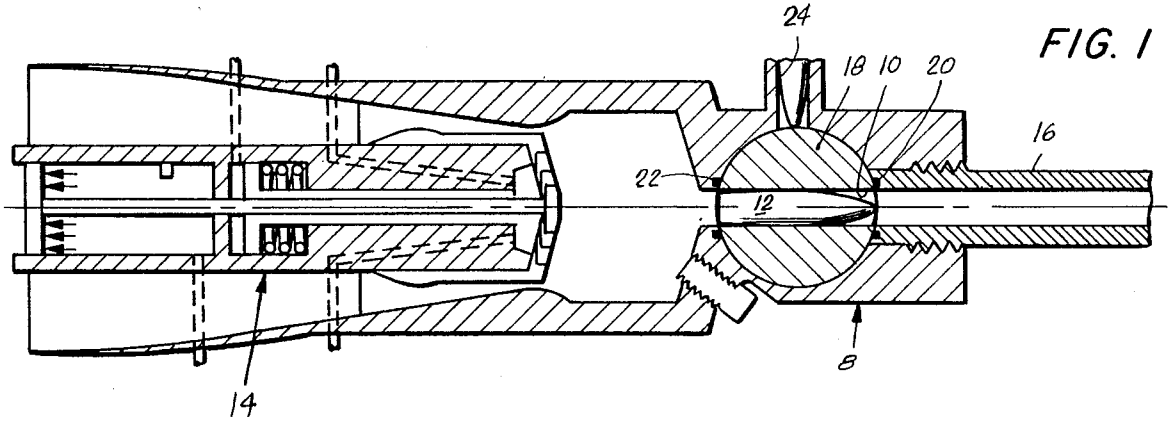
FIG. 1 is a view in side elevation in longitudinal cross-section of a gun embodying this invention, showing the arrangement of parts before charging the gun with liquid propellant.
Figure 2:
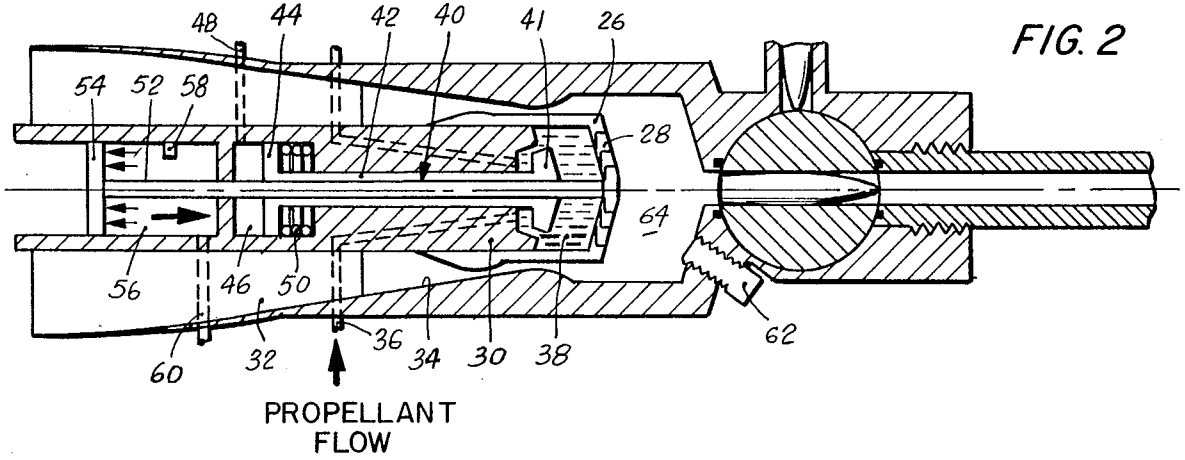
FIG. 2 is a view similar to FIG. 1 showing the arrangement of parts during charging the gun with liquid propellant.
Figure 3:
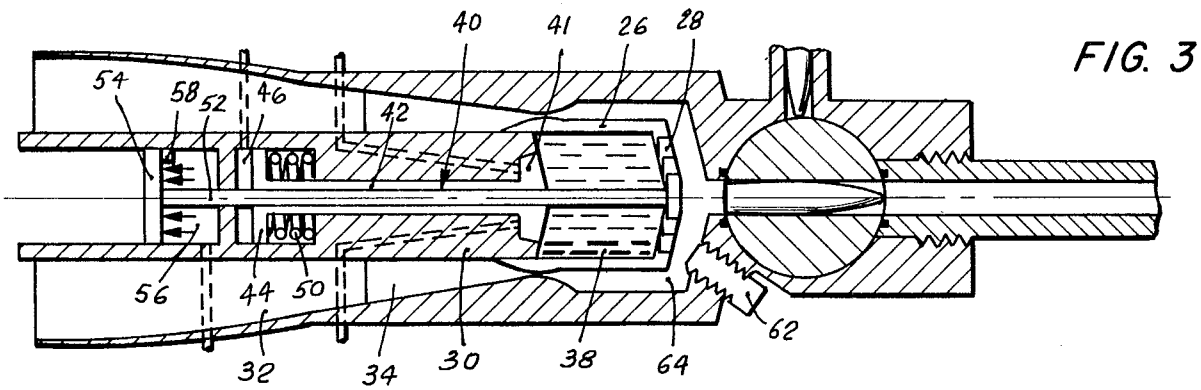
FIG. 3 is a view similar to FIG. 1 showing the arrangement of parts after charging and ready to fire.
Figure 4:
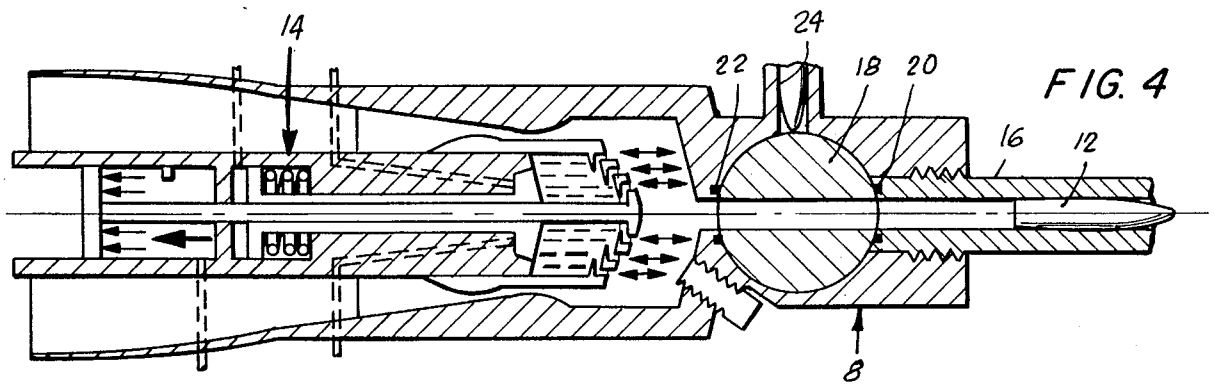
FIG. 4 is a view similar to FIG. 1 showing the arrangement of parts during firing.

FIGS. 1 through 4 illustrate a liquid propellant recoilless gun utilizing a differential piston embodying this invention. The gun consists of a breech assembly 8 having a chamber 10 in which a projectile 12 is received before firing, and a thrust reaction system 14 behind the projectile chamber 10. A gun barrel 16 is fixed to the breech assembly forward of the projectile chamber. The projectile chamber 10 is here shown as formed in a rotating block 18 with a forward annular seal 20 and an aft annular seal 22. A projectile feed system 24 supplies projectiles in sequence to the projectile chamber 10. The thrust reaction system 14 includes a sleeve piston 26 having a concentric ring injector system 28 as its piston head or forward end. The embodiment of the injector system here shown utilizes interlocking lug or spline teeth to retain the rings nested and to limit the relative motion between adjacent rings. The sleeve piston 26 is supported by and slides with respect to a central pedestal 30. The pedestal is fixed by a plurality of radial struts 32 on the longitudinal axis of the recoil nozzle 34 of the thrust reaction system. The pedestal includes a plurality of passageways 36 for supplying liquid propellant to a pumping chamber 38 disposed between the piston head 28 and the forward end of the pedestal, and a check valve 40. The check valve includes a head 41 which is coupled by a tubular stem 42 to a piston 44 which operates in a cylinder 46. The pedestal also includes a passageway 48 for providing liquid pressure into the cylinder aft of the piston. A helical compression spring 50 is disposed in the cylinder forward of the piston. The pedestal further includes a control rod 52 disposed within the central longitudinal bore of the check valve, whose forward end is coupled to the injector system 28 and whose aft end is fixed to a piston 54 which operates in a cylinder 56 having a forward stop 58, and a passageway 60 for providing fluid pressure into the cylinder 56 forward of the piston 54. An ignition system 62 opens into a combustion chamber 64 which is disposed aft of the projectile chamber 18 and forward of the injector system 28. The ignition system may be any suitable means for supplying hot, high pressure gas to initiate the regenerative piston action, such as a replaceable pyrotechnic system, or metering in a small quantity of liquid propellant and igniting it as shown in U.S. Pat. No. 3,763,739, issued to D. P. Tassie on Oct. 9, 1973.

The injector system 28 serves both as the head of a differential piston and as a poppet valve. During the firing portion of the gun cycle the injection system must pass liquid propellant from the pumping chamber into the combustion chamber. During the remainder portion of the gun cycle such passage must be barred.

Figure 5:
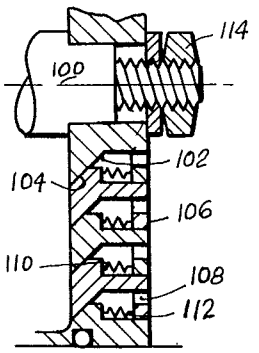
FIG. 5 is a detail schematic view illustrating the basic concept of the construction of the differential piston of the gun of FIG. 1 utilizing chevron rings and a central piston rod.

FIG. 5 illustrates a first embodiment of the injector system comprising a concentric ring construction. The concentric ring piston head is carried on a central piston rod 100. The head is comprised of a series of rings, each having a forward facing chevron valve seat 102 and an aftward facing chevron valve seat 104, as shown in my earlier patent, U.S. Pat. No. 3,782,241, issued Jan. 1, 1974. The arrangement permits the aft surface of the head to be flat and imperforate when the rings are nested. Each ring also has an annular, forward shoulder 106 with a plurality of longitudinal holes 108 therethrough, disposed in an annular row, and an aft shoulder 110. An annular compression spring 112, shown schematically, is disposed between the shoulder 106 of each spring and the shoulder 110 of the next adjacent spring. Each spring biases the outboard ring aft relative to the nextmost inboard ring, to force the adjacent valve seats into contact. Wavy washers, gas filled O-rings or Belleville washers may be utilized. A nut 114 fixes the innermost ring to the piston rod 100. Each ring may contain any desired number and type of injection holes 108.

Figure 6:
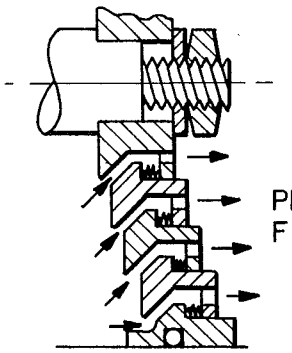
FIG. 6 is a view similar to FIG. 5 showing the arrangement of parts permitting flow of liquid propellant through the head of the piston.

In operation, as fluid enters to the aft or left face of the piston head as shown in FIG. 5, the springs hold the valve seats closed as shown. The springs must be strong enough to withstand filling pressure without allowing the rings to separate. The springs must be preloaded to do this. After ignition, pressure on the forward or right face of the head generates sufficiently high force to overcome the preloading forces on the springs, and the rings begin to separate, spacing apart the valve seats, to permit the liquid propellant to flow through these spaces and out the injection holes. When full flow is established, the piston head assumes the configuration shown in FIG. 6.

Figure 7:
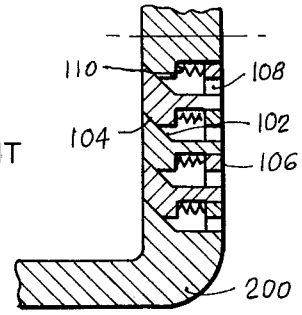
FIG. 7 is a detail schematic view of another embodiment of the piston using a sleeve in lieu of a central piston rod.

FIG. 7 illustrates a second embodiment of the injector system utilizing an outer sleeve 200 as the retention member, in lieu of the central piston rod 100 of FIG. 5. The angle of the valve seats 102, 104 is the mirror image of those shown in FIG. 5, and the shoulders 106, 110 are outwardly directed. The operation of the sleeve system is similar to that of the central rod system of FIG. 5. The advantage of the sleeve piston is the fact that the ring circumference increases as the cumulative load transmitted from ring to ring also increases. The strength of the ring to ring engagement is easier to maintain. In the central rod piston, by contrast, the largest cumulative load must be terminated at the smallest diameter, that of the rods.

FIGS. 5 and 7 have shown rings having chevron or conical sealing surfaces. If the aft surface of the piston head can be stepped rather than flat, then rings having flat sealing surfaces 302, 304 may be utilized as in the third embodiment shown in FIG. 8.

Figure 8:
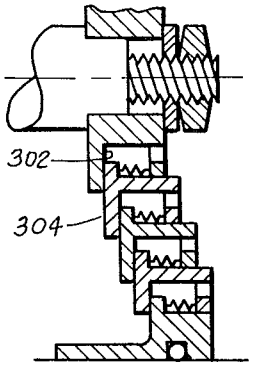
FIG. 8 is a detail schematic view of yet another embodiment of the piston utilizing flat surface rings.

The rings shown in FIGS. 5, 7 and 8 are not separable, and the annular shoulder 106 has to be joined to its respective ring as the assembly of rings and springs is built up. This is accomplished, for example, by mutually threading the shoulder and the ring, or by brazing. An alternative is to have rings utilizing shoulders defined by spaced apart lugs, wherein the lugs of one shoulder will pass through the spaces or lacunae of the adjacent shoulder and then can be rotated to interlock.

Figure 9:
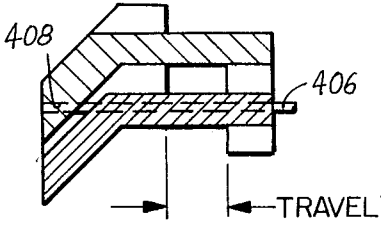
FIGS. 9 and 10 are detail schematic views of still another embodiment of the piston utilizing interrupted lug chevron rings.
Figure 10:
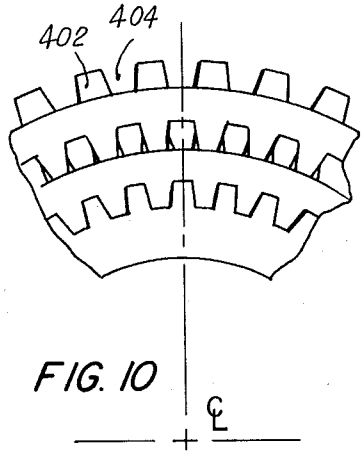
Figure 11:
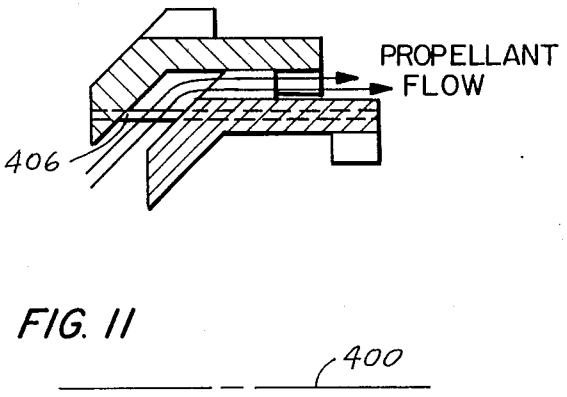
FIG. 11 is a view similar to FIG. 9 showing the arrangement of parts permitting flow through the head of the piston.

FIGS. 9 and 10 illustrate a fourth embodiment of the injector system utilizing a central piston rod 400 and rings having lugs 402 and lacunae 404. Two rings out of a plurality are shown nested. The lugs and lacunae are formed as spline or gear teeth. While the lacunae may never be narrower than the lugs which they pass, they may be wider. The lacunae serve as the injection holes and the rate of flow of the liquid propellant is a function of their cross-sectional area. The rings are centrally engaged and then rotated one-half pitch and then locked by a pin 406 through a bore 408 which passes through both rings. The pin is fixed to one ring and is free in the other ring, to permit relative longitudinal movement, as shown in FIG. 11.

Figure 12:
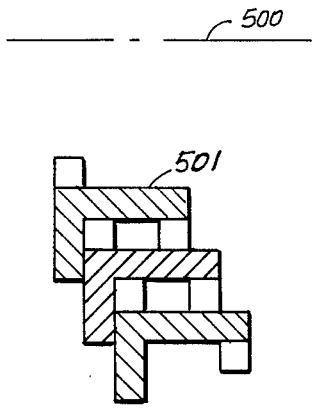
FIG. 12 is a detail schematic view of even another embodiment of the piston utilizing interrupted lug flat rings.
Figure 13:
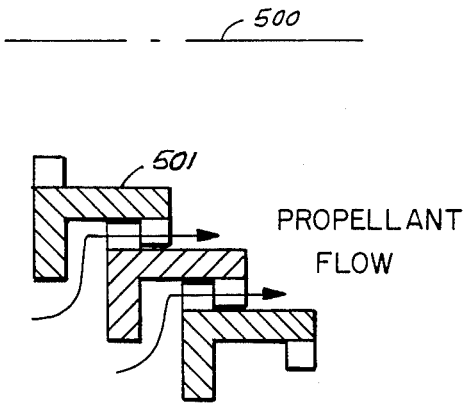
FIG. 13 is a view similar to FIG. 12 showing the arrangement of parts permitting flow through the head of the piston.

FIGS. 12 and 13 illustrate a fifth embodiment of the injector system utilizing a central piston rod 500 and flat rings 501 having lugs and lacunae.

By varing the cross-sectional area of the injection bores and the spring force in each ring, a progressive or sequentional opening of the flow passageways can be achieved. Thus, flow can be gradually increased as pressure increases. A small "squirt" of fluid for ignition can be developed by having one spring quite weak behind a few holes.

Figure 14:
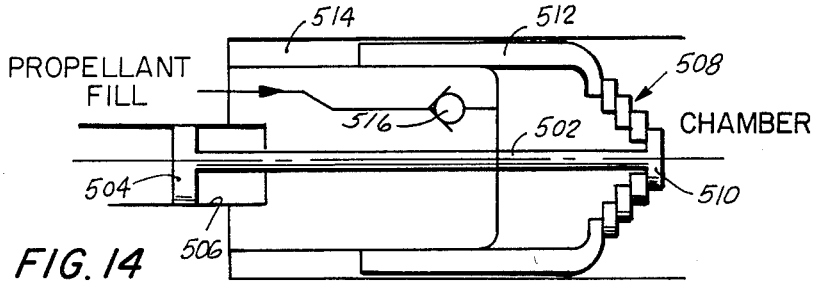
FIG. 14 is a schematic view of a first control rod technique.

As shown in FIG. 14, a control technique can replace the individual springs in controlling the position of the concentric rings during fill and firing. The springs are eliminated, and the control rod permits accurate metering of the liquid propellant charge by providing a stop to end the travel of the rings. The control rod 502 is held aft by pneumatic, hydraulic or even propellant pressure behind its piston head 504 in a cylinder 506. The nested ring elements 508, including the inner element 510 which is fixed to the forward end of the rod, and the outermost element 512 which extends as a sleeve piston into a cylinder 514 whose aft end is vented to atmospheric pressure, serve as the injector, differential pressure, piston head. The transverse cross-sectional area of the sleeve element 512 provides the major difference between the cross-sectional area of the front or combustion chamber face of the head and the cross-section area of the aft or pumping chamber face of the head. The transverse cross-sectional area of the rod 502 provides a minor difference. When the propellant enters through the check valve 516, the center element tends to remain aft, holding all of the other nested elements aft. The pressure of the entering propellant opposes the force provided by the piston head 504, to seat the nested elements even more firmly in a sealed interrelationship. When the total force on all of the elements exceeds the hold back force of the piston head, the nested element assembly will begin to move forwardly. The hold back force must still be great enough to hold all of the elements together. Too low a hold back force could allow some or all of the elements to separate. Actually the hold back force has to exceed the sum of inertia and friction forces on all of the elements except the center one to prevent premature opening of the assembly. When the control rod reaches its forward limit, pressure can remain on indefinitely. The filled piston will remain waiting for chamber pressure to start the firing action.

Damping will be provided as the piston approaches its forward limit.

Figure 15:
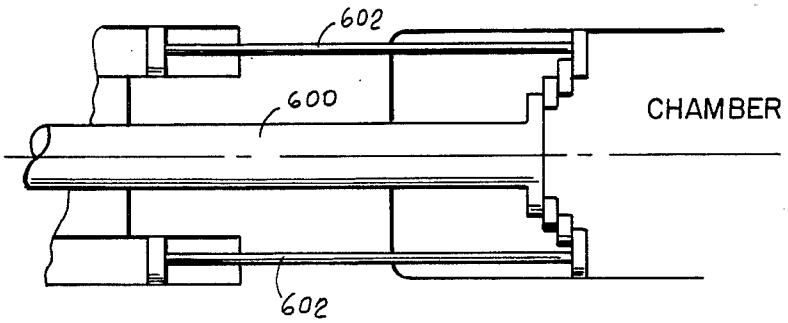
FIG. 15 is a schematic view of a second control rod technique.

A similar control technique can be applied to conventional piston construction with a center rod 600, as shown in FIG. 15. Here the major difference in cross-sectional areas is provided by the center rod 600, and the minor difference by the control rods 602.

In both of the arrangements shown in FIGS. 14 and 15, it will be noted that during the injection stroke, as the injector head moves aft reducing the volume of the pumping chamber under the influence of the difference in pressures on the front and aft faces of the injector head, after the sleeve element 514 or the rod 600 has reached its aft limit of travel, the differential pressure on the ring elements will cause these elements to nest tightly, sealing up the injector head.

It will be appreciated that the disclosed concentric ring element construction provides a relatively simple construction without the need for separate poppets, to provide an injector, differential pressure, piston head which can be sealed during the filling of the pumping chamber, and yet has a generous flow orifice area during the injection stroke. The disclosed control rod technique eliminates the need for individual return spring between the ring elements, provides damping at the end of the filling stroke, and provides an easy method of metering the propellant charge into the pumping chamber.

What is claimed is:

1. A valve assembly having a first longitudinal axis and comprising:

a plurality of rings disposed in a nested array, including an outermost ring, intermediate rings and a central solid ring, each of said rings having a respective longitudinal axis in common with said first longitudinal axis;

said outermost ring having an inner periphery adjacent an intermediate ring;

each intermediate ring having an outer periphery and an inner periphery;

said central ring having an outer periphery;

each of one of the group comprising said inner and said outer peripheries having a first annular sealing surface and a first annular row of spaced apart teeth;

each of the other of the group comprising said inner and said outer peripheries having a second annular sealing surface and a second annular row of spaced apart teeth;

with respect to immediately adjacent rings, the teeth of said second row being adapted to longitudinally pass between the teeth of said first row, and to transversely pass into alignment with the teeth of said first row, and the inner adjacent ring being adapted to move longitudinally relative to said outer adjacent ring from a first position, whereat said second sealing surface of said inner ring abuts said first sealing surface of said outer ring, to a second position, whereat said second, surface is spaced from said first surface, whereby when said rings are all in said first position, the flow of fluid through said assembly is precluded, and when any ring is in said second position, the flow of fluid through said assembly is enabled.

2. An assembly according to claim 1 wherein;

said first rows of teeth are on said inner peripheries.

3. An assembly according to claim 1 wherein;

on each respective ring said first row of teeth is longitudinally spaced from said second row of teeth.

4. An assembly comprising a group including a first element and a second element mutually defining a closed chamber and coupled for relative movement with respect to each other to vary the volume of said closed chamber, one of the members of said group including a valve assembly having a first longitudinal axis and comprising:

a plurality of rings disposed in a nested array, including an outermost ring, intermediate rings and a central solid ring, each of said rings having a respective longitudinal axis in common with said first longitudinal axis;

said outermost ring having an inner periphery adjacent an intermediate ring;

each intermediate ring having an outer periphery and an inner periphery;

said central ring having an outer periphery adjacent an intermediate ring;

said rings being nested with the inner periphery of each ring being adjacent the outer periphery of the next adacent ring and defining a set of peripheries;

each set of peripheries including a set of mating sealing surfaces, and means to permit limited longitudinal movement of the respective rings from a mutually sealing disposition to a mutually spaced apart disposition;

having a mode of operation such that when the fluid is introduced under pressure into said chamber to cause enlargement of the volume of said chamber, said rings are disposed in said mutually sealing disposition, and that when relative movement is provided between said first element and said second element to cause reduction of said volume of said chamber, said rings are disposed in said mutually spaced apart disposition to permit the flow of fluid therethrough.

5. A liquid propellant gun having a first element, a second element, and an annular piston, said first element and said piston mutually defining a combustion chamber and said second element and said piston mutually defining a pumping chamber, all having a first longitudinal axis, and said piston having:

a plurality of rings disposed in a nested array, including an outermost ring, intermediate rings and a central solid ring, each of said ring having a respective longitudinal axis in common with said first longitudinal axis;

said outermost ring having an inner periphery adjacent an intermediate ring;

each intermediate ring having an outer periphery and an inner periphery;

said central ring having an outer periphery adjacent an intermediate ring;

said rings being nested with the inner periphery of each ring being adjacent the outer periphery of the next adjacent ring and defining a set of peripheries;

each set of peripheries including a set of mating sealing surfaces, and means to permit limited longitudinal movement of the respective rings from a mutually sealing disposition to a mutaully spaced apart disposition;

having a mode of operation such that when fluid is introduced under pressure into said pumping chamber to cause enlargement of the volume of said pumping chamber, said rings are disposed in said mutually sealing disposition, and that when relative movement is provided between said piston and said second element to cause reduction of said volume of said pumping chamber, said rings are disposed in said mutually spaced apart disposition to permit the flow of fluid therethrough into said combustion chamber.

6. A liquid propellant gun having an annular piston disposed between a pumping chamber and a combustion chamber and having a first longitudinal axis and comprising:

a plurality of rings disposed in a nested array, including an outermost ring, intermediate rings and a central solid ring, each of said rings having a respective longitudinal axis in common with said first longitudinal axis;

said outermost ring having an inner periphery adjacent an intermediate ring;

each intermediate ring having an outer periphery and an inner periphery;

said central ring having an outer periphery;

each of one of the group, which group comprises said inner and said outer peripheries, having a first annular sealing surface and a first annular row of spaced apart teeth;

each of the other of said group, which group comprises said inner and said outer peripheries, having a second annular sealing surface and a second annular row of spaced apart teeth;

with respect to immediately adjacent rings, the teeth of said second row being adapted to longitudinally pass between the teeth of said first row, and to transversely pass into alignment with the teeth of said first row, and the inner adjacent ring being adapted to move longitudinally relative to said outer adjacent ring from a first position, whereat said second sealing surface of said inner ring abuts said first sealing surface of said outer ring, to a second position, whereat said second surface is spaced from said first surface, whereby when said rings are all in said first position, the flow of fluid through said assembly is precluded, and when any ring is in said second position, the flow of fluid through said assembly is enabled.

7. A gun according to claim 6 wherein:

said first rows of teeth are on said inner peripheries.

8. A gun according to claim 6 wherein:

on each respective ring said first row of teeth is longitudinally spaced from said second row of teeth.

9. A pump assembly comprising:

a first element and a second element mutually defining a closed chamber;

said first element including a valve assembly having a first longitudinal axis and comprising:

a plurality of transversely overlapping elements disposed to define a transverse wall having a first face and a second face in a nested array, including an outer ring and a central control rod, each of said elements having a respective longitudinal axis in common with said first longitudinal axis, first means for controlling the longitudinal displacement of said control rod with respect to the longitudinal disposition of said outermost ring, second means for applying fluid pressure to said first face of said wall, which pressure is greater than that applied to said second face of said wall, third means for applying fluid pressure to said second face of said wall, which pressure is greater than that applied to said first face of said wall, and having a mode of operation such that when said second means applies pressure to said first face, said ring and said rod are disposed in a mutually closed disposition, and that when said third means applies pressure to said second face, said ring and said rod are disposed in a mutually spaced apart disposition.

10. A liquid propellant gun having an annular piston disposed between a pumping chamber and a combustion chamber and having a first longitudinal axis comprising:

said annular piston including a valve assembly comprising:

a plurality of transversely overlapping elements disposed in a nested array to define a piston end wall having a pumping chamber face and a combustion chamber face, including:

an outer ring and a central control rod, each of said elements having a respective longitudinal axis in common with said first longitudinal axis, first means biasing said rod to displace said psiton end wall to minimize the volume of said pumping chamber, second means for applying fluid pressure to said pumping chamber face of said piston end wall and adapted to overcome the bias of said face means to enlarge the volume of said pumping chamber, third means for applying fluid pressure to said combustion chamber face of said piston end wall and adapted to overcome the pressure of said second means to decrease the volume of said pumping chamber, and having a mode of operation such that when said second means applies pressure to said pumping chamber face, said ring and said rod are disposed in a mutually closed disposition and that when said third means applies pressure to said combustion chamber face, said ring and said rod are disposed in a mutually spaced apart disposition.

* * * * *